US008356440B2

(12) United States Patent
Troy

(10) Patent No.: US 8,356,440 B2
(45) Date of Patent: Jan. 22, 2013

(54) MAGAZINE WITH SHOCK ABSORBING TAB

(76) Inventor: Stephen P. Troy, Lee, MA (US)

( * ) Notice: Subject to any disclaimer, the term of this patent is extended or adjusted under 35 U.S.C. 154(b) by 76 days.

(21) Appl. No.: 13/006,731

(22) Filed: Jan. 14, 2011

(65) Prior Publication Data

US 2011/0173858 A1 Jul. 21, 2011

Related U.S. Application Data

(60) Provisional application No. 61/295,975, filed on Jan. 18, 2010.

(51) Int. Cl.
*F41A 9/65* (2006.01)

(52) U.S. Cl. ..... 42/50; 42/49.01; 42/90

(58) Field of Classification Search ..... 42/49.01–49.1, 42/11, 17–18, 21–22, 29, 33, 35, 37, 39, 42/7, 6, 90

See application file for complete search history.

(56) References Cited

U.S. PATENT DOCUMENTS 5,592,769 A * 1/1997 Villani ..... 42/1.02
6,481,136 B1 * 11/2002 Fitzpartick ..... 42/50
6,748,689 B2 * 6/2004 Fitzpatrick ..... 42/50
6,883,261 B2 * 4/2005 Fitzpatrick ..... 42/50
7,174,666 B2 * 2/2007 Fitzpatrick ..... 42/50
7,207,131 B2 * 4/2007 Fitzpatrick ..... 42/50
8,033,043 B2 * 10/2011 McGarry ..... 42/70.08
8,061,071 B2 * 11/2011 Fitzpatrick et al. ..... 42/50
2003/0066227 A1 * 4/2003 Fitzpatrick ..... 42/50
2004/0255503 A1 * 12/2004 Fitzpatrick ..... 42/49.01
2004/0255504 A1 * 12/2004 Fitzpatrick ..... 42/49.01
2005/0188579 A1 * 9/2005 Gates ..... 42/50
2010/0126053 A1 * 5/2010 Fitzpatrick et al. ..... 42/50
2010/0281737 A1 * 11/2010 Cahill ..... 42/50
2012/0085010 A1 * 4/2012 Cook ..... 42/7
2012/0091173 A1 * 4/2012 Crye ..... 224/196

* cited by examiner

*Primary Examiner* — Michael David
(74) *Attorney, Agent, or Firm* — Parsons & Goltry; Robert A. Parsons; Michael W. Goltry

(57) ABSTRACT

An ammunition magazine including a housing having a first end and an opposing second end for carrying stacked cartridges, a follower plate reciprocally movable within the housing, a spring retainer reciprocally movable within the housing and having an extension tab extending therefrom toward the second end, and a biasing member carried by the housing between the follower plate and the spring retainer. The biasing member biases the follower plate toward the first end and biases the spring retainer toward the second end. A bottom plate closes the second end of the housing and retains the spring retainer within the housing. The bottom plate includes an opening extending therethrough permitting passage of the extension tab therethrough in reciprocal directions.

14 Claims, 4 Drawing Sheets

MAGAZINE WITH SHOCK ABSORBING TAB

CROSS-REFERENCE TO RELATED APPLICATION

This application claims the benefit of U.S. Provisional Application No. 61/295,975, filed 18 Jan. 2010.

FIELD OF THE INVENTION

This invention relates to firearm accessories.

More particularly, the present invention relates to magazines for firearms.

BACKGROUND OF THE INVENTION

In the field of firearms, magazines are employed for quickly and easily providing multiple cartridges to the receiver of a firearm. Many types of magazines are used with an assortment of firearms and cartridges. Magazines can include single column, double column and the like. Additionally, cartridges can be stacked directly aligned or offset in a staggered configuration. Each of the various types of magazines has its benefits and problems. However, each typically includes a channel to receive a plurality of cartridges and the channel is defined by a case/housing. A spring operated follower presses the cartridges carried in the housing to an upper position in the channel. In this position, the topmost cartridge is ready for feeding into a chamber of the firearm. Magazines typically include a pair of retaining lips which move between an open position and a retaining position. The retaining lips permit selective release of cartridges from the top of the case. While successfully used for many years, magazines can be sensitive to shock and rough handling. During high stress times, or when haste becomes an issue, magazines can be dropped, knocked or otherwise shocked, causing cartridges therein to misalign, result in damage to the magazine itself, or cause other undesirable results.

Magazines are often carried in pouches which tightly grip the case/housing to prevent movement and so as to limit shock to the magazines during storage. In this manner magazines are well protected when stored, and easily located. The problems arise when extraction of a magazine from a storage pouch for loading into a firearm is required. Pouches often fully receive a magazine, leaving no exposed portions for convenient gripping. Sometimes, replacing a depleted magazine with a fully charged one is time critical. Fumbling with a pouch to remove a magazine could be extremely detrimental.

It would be highly advantageous, therefore, to remedy the foregoing and other deficiencies inherent in the prior art.

SUMMARY OF THE INVENTION

Briefly, to achieve the desired objects and advantages of the instant invention provided is an ammunition magazine. The ammunition magazine includes a housing having a butt end and a bottom plate having an opening formed therethrough, the bottom plate closing butt end other than at the opening. Also included is a spring retainer with an extension tab extending therefrom. The spring retainer is reciprocally movable within the housing between an expanded position and a compressed position. In the expanded position the spring retainer is adjacent the bottom plate and the extension tab extends through the opening in the bottom plate. In the compressed position the spring retainer is spaced apart from the bottom plate. A biasing member biases the spring retainer into the expanded position.

In another aspect, the housing of the ammunition magazine includes a feed end opposite the butt end. The feed end carries feed lips that are movable between an open position and a retaining position. Also included is a follower plate reciprocally movable within the housing between the feed end and the spring retainer. The follower plate is biased by the biasing member toward the feed end.

In yet a further aspect, provided is an ammunition magazine which includes a housing for carrying stacked cartridges. The housing includes a first end and an opposing second end. A follower plate is reciprocally movable within the housing. A spring retainer is reciprocally movable within the housing and has an extension tab extending therefrom toward the second end. A biasing member is carried by the housing between the follower plate and the spring retainer. The biasing member biases the follower plate toward the first end and biases the spring retainer toward the second end. A bottom plate closes the second end of the housing and retaines the spring retainer within the housing. The bottom plate includes an opening extending therethrough permitting passage of the extension tab therethrough in reciprocal directions.

BRIEF DESCRIPTION OF THE DRAWINGS

Specific objects and advantages of the instant invention will become readily apparent to those skilled in the art from the following detailed description of a preferred embodiment thereof taken in conjunction with the drawings, in which.

DETAILED DESCRIPTION OF THE PREFERRED EMBODIMENTS

Figure 1:
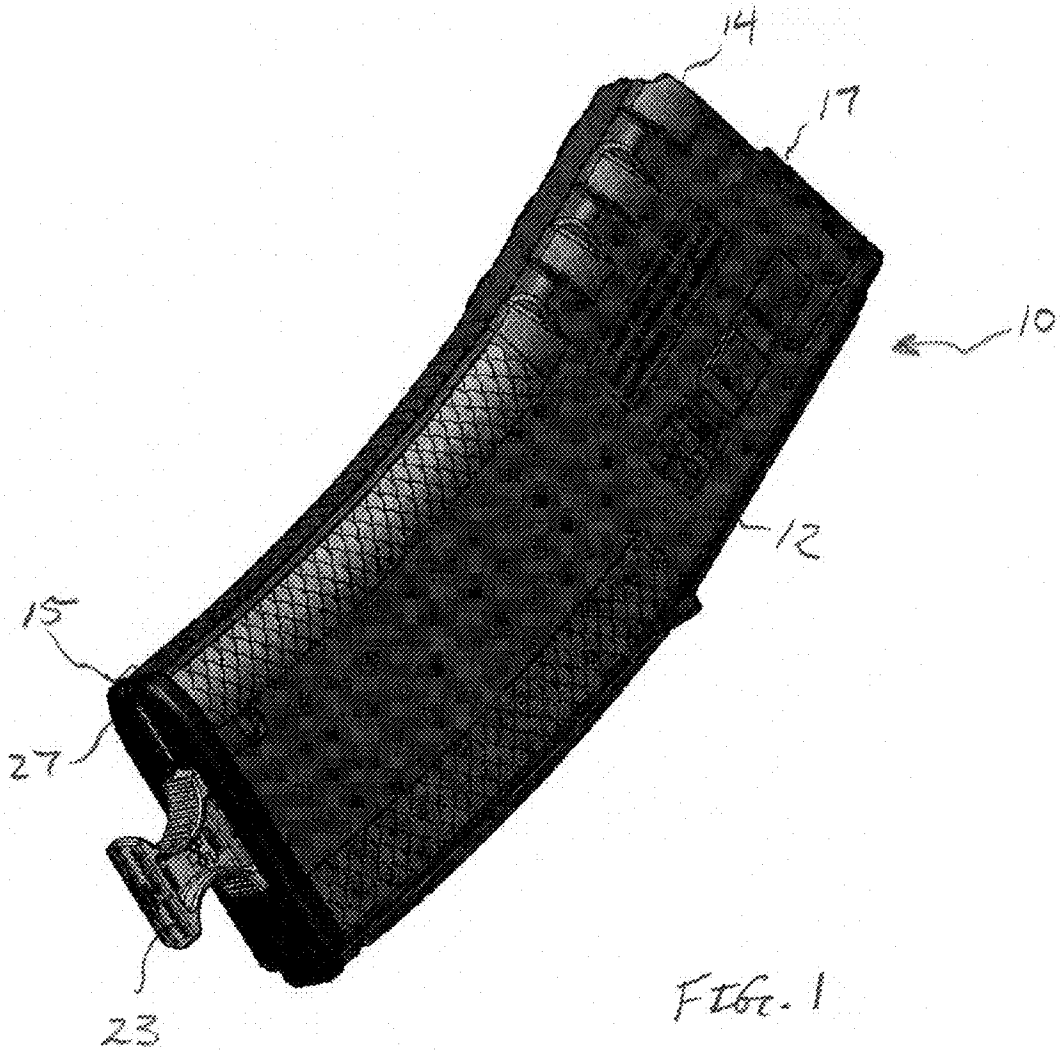
FIG. 1 is a side view of a magazine according to the present invention.

Turning now to the drawings in which like reference characters indicate corresponding elements throughout the several views, attention is first directed to FIG. 1 which illustrates an ammunition magazine generally designated 10. Magazine 10 includes a housing 12 having opposing feed end 14, and butt end 15. Housing 12 is sized and shaped to carry ammunition of the desired type, caliber and number of cartridges. It will be understood that a variety of types of magazines can be altered to provide the structure and benefits of the present invention. For example, magazines can store cartridges in an aligned stack, or staggered stack configurations. Additionally, single and double stack magazines are known, and may employ the present invention. Feed end 14 includes feed lips 17 which mate with the receiver of a firearm. Lips 17 are movable between an open position and a retaining position. Lips 17 permit selective release of cartridges from feed end 14 to accurately feed cartridges carried within housing 12 into the chamber of the firearm in the open position and retain the cartridges in the retaining position. Butt end 15 extends outwardly from a firearm when in position, and is typically the end grasped when withdrawing the magazine from a pouch.

Figure 2:
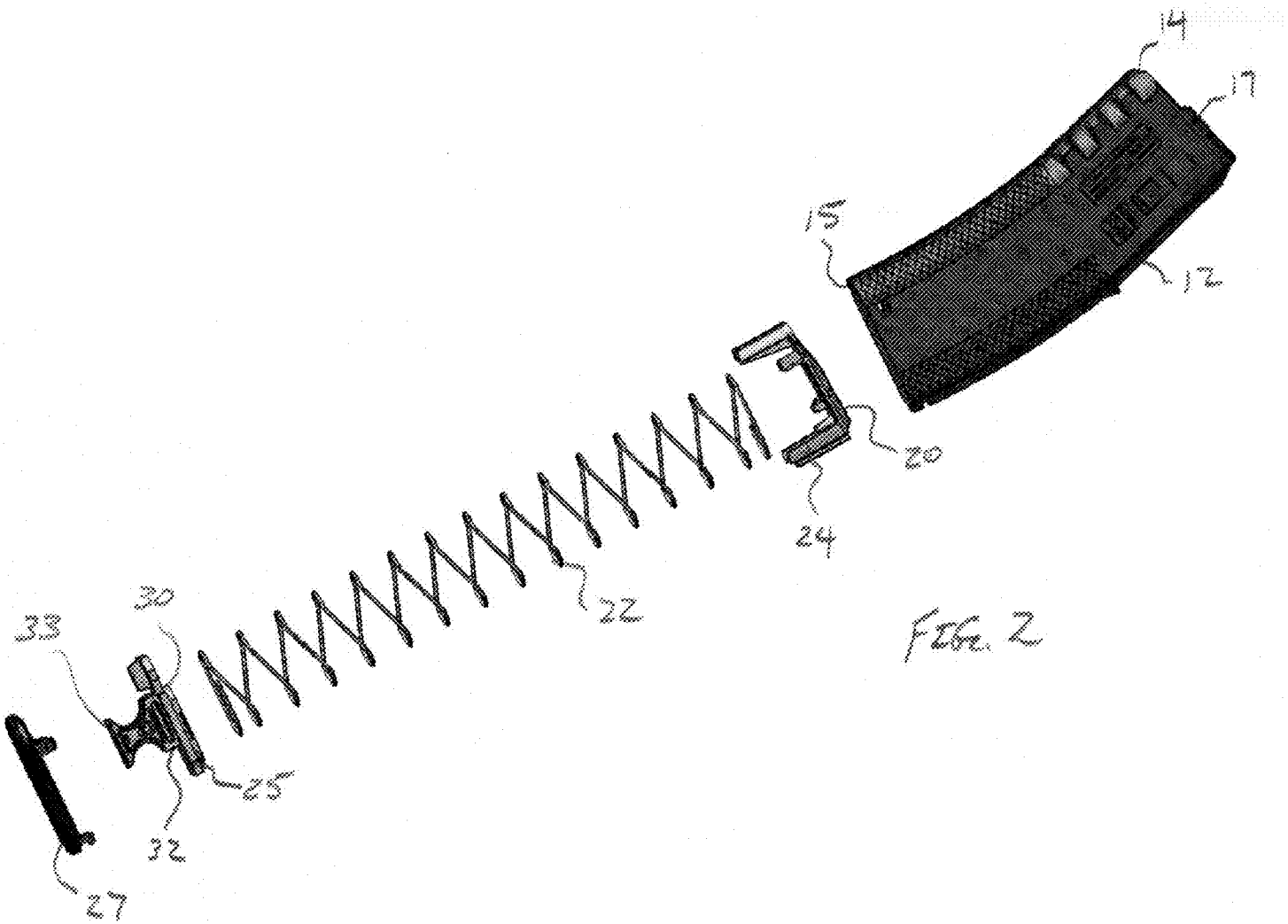
FIG. 2 is an exploded view of the magazine of FIG. 1.
Figure 3:
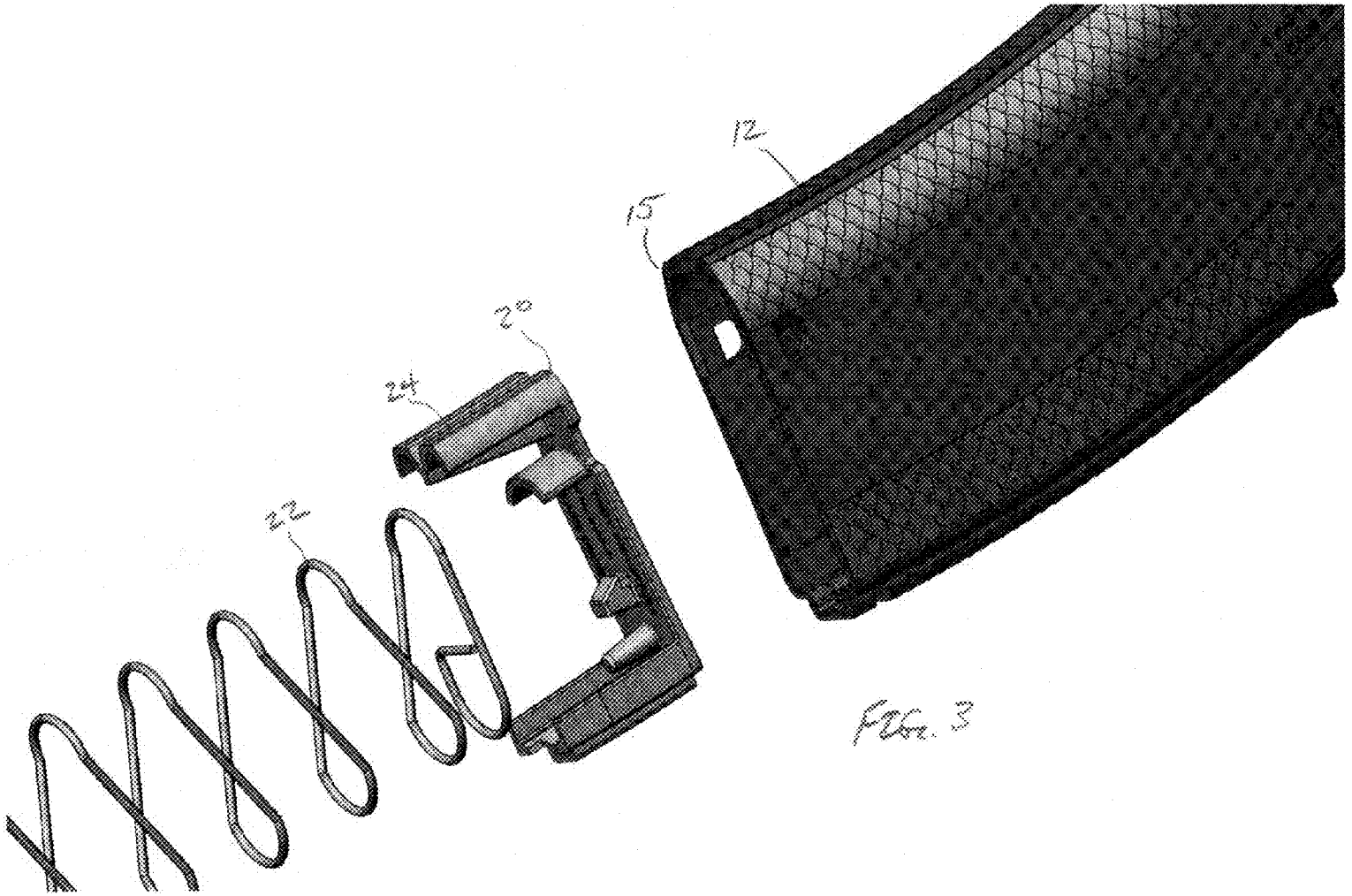
FIG. 3 is an enlarged perspective view of the magazine spring and follower plate.
Figure 4:
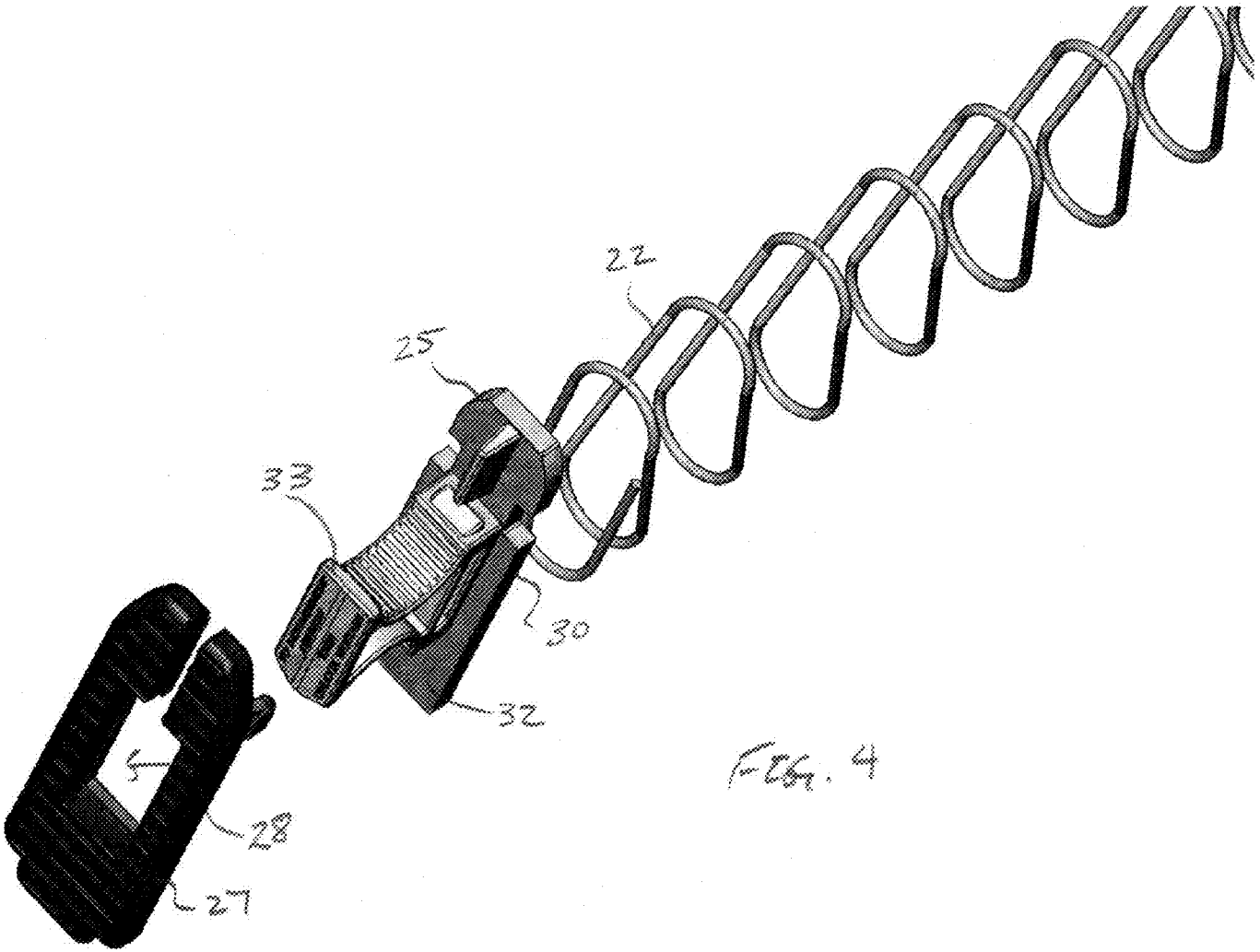
FIG. 4 is an enlarged perspective view of the magazine spring bottom plate and pull tab.

With additional reference to FIGS. 2, 3 and 4, magazine 10 further includes a follower plate 20 reciprocally moveable within housing 12 between butt end 15 and feed end 14, and biased towards feed end 14 by a biasing member such as a magazine spring 22. Magazine spring 22 is a compression spring carried within housing 12 between follower plate 20 and a spring retainer 25. Follower plate 20 is engaged by and retains an end of magazine spring 22 (FIG. 3). Guides 24 extend perpendicularly from corners of follower plate 20, riding along in a sliding engagement with the inner surfaces of housing 12 to insure level and smooth reciprocal movement of follower plate 20 within housing 12.

Spring retainer 25 is carried proximate butt end 15 and is reciprocally moveable within housing 12 between butt end 15 and follower plate 20, and is biased towards butt end 15 by magazine spring 22. Spring retainer 25 is prevented from being forced out of butt end 15 by a bottom plate 27. Bottom plate 27 includes an opening 28 (FIG. 4) and is fixedly attached to butt end 15 of housing 12. Bottom plate 27 closes butt end 15 other than at opening 28, for purposes that will be described presently. Spring retainer 25 includes a feed surface 30 shaped to receive an end of magazine spring 22, and an opposing butt surface 32 (FIG. 3). An extension tab 33 extends perpendicularly from butt surface 32, and is shaped to be received through opening 28. Extension tab 33 is also shaped to be easily and securely grasped by a user when withdrawing magazine 10 from a storage pouch and the like. In this manner, magazine spring 22 normally forces spring retainer 25 against bottom plate 27, forming a solid base upon which spring 22 can be compressed by charging with cartridges. Thus, spring retainer 25 is reciprocally movable within the housing between an expanded position wherein spring retainer 25 is adjacent bottom plate 27 and extension tab 33 extends through opening 28 in bottom plate 27, and a compressed position in which spring retainer 25 is spaced apart from bottom plate 27. Since spring retainer 25 is reciprocally moveable within housing 12, if magazine 10 is dropped or butt end 15 comes into contact with a hard surface for some reason, extension tab 33 will absorb the shock by first contacting the surface and forcing spring retainer 25 toward free end 14 against spring 22.

When cartridges are loaded in feed end 14, they move follower plate 20 toward butt end 15, compressing magazine spring 22 against spring retainer 25 which is held solidly from moving in the direction of butt end 15 by bottom plate 27. The cartridges are held in a stacked orientation between the feed lips and follower plate 20. In this position, extension tab 33 can act as a tab for withdrawing magazine 10 from a pouch or pocket, and as a shock absorber if dropped. It will be understood that to permit this to occur with a fully charged magazine, there must be a slight excess of spring capacity and space for movement between spring retainer 25 and follower plate 20.

Various changes and modifications to the embodiments herein chosen for purposes of illustration will readily occur to those skilled in the art. To the extent that such modifications and variations do not depart from the spirit of the invention, they are intended to be included within the scope thereof, which is assessed only by a fair interpretation of the following claims.

Having fully described the invention in such clear and concise terms as to enable those skilled in the art to understand and practice the same, the invention claimed is:

The invention claimed is:

1. An ammunition magazine comprising:

a housing having a butt end;

a bottom plate having an opening formed therethrough, the bottom plate closing the butt end other than at the opening;

a spring retainer with an extension tab extending therefrom, the spring retainer reciprocally movable within the housing between an expanded position wherein the spring retainer is adjacent the bottom plate and the extension tab extends through the opening in the bottom plate, and a compressed position in which the spring retainer is spaced apart from the bottom plate, the extension tab configured to be easily grasped by a user and to absorb shocks; and a biasing member biasing the spring retainer into the expanded position.

2. An ammunition magazine as claimed in claim 1 wherein the housing further includes a feed end opposite the butt end, the feed end carrying feed lips that are movable between an open position and a retaining position.

3. An ammunition magazine as claimed in claim 2 further including a follower plate reciprocally movable within the housing between the feed end and the spring retainer, the follower plate biased by the biasing member toward the feed end.

4. An ammunition magazine as claimed in claim 3 wherein the follower plate includes guides extending perpendicularly from corners thereof toward the butt end, the guides in sliding engagement with the housing.

5. An ammunition magazine as claimed in claim 1 wherein the biasing member is a compression spring.

6. An ammunition magazine for holding a plurality of cartridges, the ammunition magazine comprising:

a housing for carrying stacked cartridges, the housing including a first end and an opposing second end;

a follower plate reciprocally movable within the housing;

a spring retainer reciprocally movable within the housing and having an extension tab extending therefrom toward the second end;

a biasing member carried by the housing between the follower plate and the spring retainer, the biasing member biasing the follower plate toward the first end and biasing the spring retainer toward the second end; and a bottom plate closing the second end of the housing and retaining the spring retainer within the housing, the bottom plate including an opening extending therethrough permitting passage of the extension tab therethrough in reciprocal directions, the extension tab extending outwardly from the second end and configured to absorb shocks.

7. An ammunition magazine as claimed in claim 6 wherein the spring retainer is reciprocally movable within the housing between an expanded position wherein the spring retainer is adjacent the bottom plate and the extension tab extends through the opening in the bottom plate, and a compressed position in which the spring retainer is spaced apart from the bottom plate.

8. An ammunition magazine as claimed in claim 6 wherein the follower plate includes guides extending perpendicularly from corners thereof toward the second end, the guides in sliding engagement with the housing.

9. An ammunition magazine as claimed in claim 6 wherein the biasing member is a compression spring.

10. An ammunition magazine comprising:

a housing carrying stacked cartridges, the housing including a feed end and an opposing butt end;

a follower plate reciprocally movable within the housing, the cartridges stacked between the follower plate and the feed end;

a spring retainer reciprocally movable within the housing and having an extension tab extending therefrom toward the butt end;

a biasing member carried by the housing between the follower plate and the spring retainer, the biasing member biasing the follower plate toward the feed end and biasing the spring retainer toward the butt end; and a bottom plate closing the butt end of the housing and retaining the spring retainer within the housing, the bottom plate including an opening extending therethrough permitting passage of the extension tab therethrough in reciprocal directions, the extension tab extending outwardly from the butt end and configured to absorb shocks.

11. An ammunition magazine as claimed in claim 10 wherein the spring retainer is reciprocally movable within the housing between an expanded position wherein the spring retainer is adjacent the bottom plate and the extension tab extends through the opening in the bottom plate, and a compressed position in which the spring retainer is spaced apart from the bottom plate.

12. An ammunition magazine as claimed in claim 10 wherein the follower plate includes guides extending perpendicularly from corners thereof toward the butt end, the guides in sliding engagement with the housing.

13. An ammunition magazine as claimed in claim 10 wherein the biasing member is a compression spring.

14. An ammunition magazine as claimed in claim 10 the further including the feed end carrying feed lips that are movable between an open position and a retaining position.

* * * * *